US006011525A

United States Patent [19]

Piole

[11] Patent Number: 6,011,525

[45] Date of Patent: Jan. 4, 2000

[54] VARIABLE HELICAL ANTENNA

[76] Inventor: Philippe Piole, 32 rue de la Rabine, 35700 Cesson-Sevigne, France

[21] Appl. No.: 09/105,209

[22] Filed: Jun. 26, 1998

[30] Foreign Application Priority Data

Jul. 4, 1997 [FR] France ..... 97-08631

[51] Int. Cl.[7] ..... H01Q 1/36

[52] U.S. Cl. ..... 343/895; 343/745

[58] Field of Search ..... 343/702, 745, 343/749, 750, 751, 752, 866, 867, 868, 895; H01Q 1/24, 1/36

[56] References Cited

U.S. PATENT DOCUMENTS

| | | | |
|---|---|---|---|
| 4,325,069 | 4/1982 | Hills | 343/750 |
| 5,469,177 | 11/1995 | Rush et al. | 343/702 |
| 5,489,916 | 2/1996 | Waterman et al. . | |
| 5,581,268 | 12/1996 | Hirshfield | 343/853 |
| 5,841,407 | 11/1998 | Birnbaum | 343/895 |

FOREIGN PATENT DOCUMENTS

WO96/19846 6/1996 WIPO .

*Primary Examiner*—Don Wong
*Assistant Examiner*—Tho Phan
*Attorney, Agent, or Firm*—Laubscher & Laubscher

[57] ABSTRACT

A variable helical antenna comprises coaxial conductive first and second helices extending in the same direction. The helices have first portions interleaved with each other without being in mechanical contact. A fixed protection member made in insulative material contains at least a portion of the first helix. A second member made in insulative material is screwed to the first member and contains at least a portion of the second helix. The second helix is attached to the second member. On screwing/unscrewing, the second helix is moved helically, by sliding on itself, relative to the first helix in order to tune the antenna to a required frequency indicated on a graduation on the fixed protection member.

11 Claims, 2 Drawing Sheets

VARIABLE HELICAL ANTENNA

BACKGROUND OF THE INVENTION

1. Field of the Invention

The present invention concerns a helical antenna for broadcasting and receiving radio waves, especially waves in the meter band for radio signals in the frequency modulation audio broadcast band in the range 87 MHz to 110 MHz, and more generally in a frequency band from approximately 70 MHz to approximately 150 MHz.

2. Description of the Prior Art

At present an emit/receive antenna operating in the above frequency band is a "whip" or "wire" antenna which is pratically omnidirectional in azimuth and consists of a substantially vertical conductive wire have a length equal to one half-wavelength, i.e. approximately one to two meters.

To improve the broadcasting of stereo radio programs and to improve listening conditions for listeners along highways, emitters synchronized to the same frequency are installed alongside the highways. The emitters can also broadcast data signals to tune receivers automatically by means of digital messages identifying radio programs. One frequency modulation radio broadcast system of this kind is known as the Radio Data System (RDS). In the context of broadcasting digital information, the information can be produced by microcomputers for broadcast to receivers associated with remote-display panels in towns and in public transport vehicles, in parking lots, etc.

For all the above applications the receive or emit/receive antenna should be small for reasons of overall size in situ and esthetics, whilst retaining the omnidirectional character in a horizontal plane inherent to audio broadcasting. To satisfy the above conditions the antenna must be short, but this is to the detriment of bandwidth, which is reduced commensurately. In this case the antenna will be tuned to a relatively narrow bandwidth of a few megahertz.

To overcome dimensional adaptation problems for the whip antenna, the latter could be replaced by a simple helical antenna with a length of only approximately 20 centimeters, i.e. a length saving in the order of 75%. By selecting the number of turns of the antenna helix by trial and error, the antenna can be tuned to the required frequency and matched to the impedance of a coaxial line to which it is connected.

An antenna of the above kind can be fixed to the top of a bus stop post or to the top of an even higher tubular post for a parking lot signposting system or to an urban remote-display screen frame, which can be more than five meters above the ground. Access is difficult to all of the above antennas.

If a working of a private or local radio station decides to change the emission frequency from the station or is replaced by another working all the receive and/or emit/receive antennas must be tuned to the new emission frequency of the station which involves changing the antennas and carrying out new measurements to tune them.

A helical antenna having four parallel conductive helices extending about a common central axis in a same direction is disclosed in U.S. Pat. No. 5,489,916. A single dielectric helix concentric with the common axis lies within the four helices, and has a length substantially equal to that of the conductive helices, which are uniformly spaced from each other and fixed to the dielectric helix. A casing contains the helices and is secured to one end of the dielectric helix. A tuning device is secured to the other end of the dielectric helix and can turn relative to the housing so that rotating the tuning device modifies the pitch of the dielectric helix and consequently the common pitch of the conductive helices without significantly varying the nominal diameter of the helices. For example, if the number of turns per unit length decreases, the length of the conductive helices increases.

Another helical antenna with four helical radiating wires or "filaments" is disclosed in PCT WIPO International patent application WO 96/19846 and also comprises means for rotating one end of the wires relative to the fixed other end thereof in order to modify the length and pitch of the fils.

Antennas of the above kind are receive antennas for a satellite telecommunication system and radiate axially with circular polarization at very high frequencies above 1 GHz. Modifying the geometry of the conductive helices modifies the aperture of the radiation diagram of the antenna in radiation directions close to the vertical axial direction.

OBJECTS OF THE INVENTION

The main object of this invention is to provide a linear polarization helical antenna remedying the drawbacks of the prior art antennas mentioned above.

Another object of this invention is more precisely to provide a helical antenna that can be tuned very easily and very quickly by non-qualified personnel without using measuring instrumentation in situ and without demounting the antenna.

SUMMARY OF THE INVENTION

Accordingly, a helical antenna comprising first and second conductive helices extending about a common central axis in the same direction is characterized in that the first and second helices have first portions interleaved with each other without being in mechanical contact, and non-interleaved second portions, the helical antenna comprises means for helically moving the second helix, by sliding on itself, relative to the first helix.

Helical moving of the second helix relative to the first helix, the helices having constant geometrical characteristics, tunes the antenna to the required frequency.

The helices are not in mechanical contact, i.e. have a galvanic insulation therebetween, and are only coupled by electromagnetic flux. This galvanic insulation between the helices improves the quality of received and/or emitted signals by the antenna when the antenna, or the part of the antenna surrounding the helix decoupled from the antenna feed coaxial cable, comes into contact with an electric wire or a metallic ground.

To center the impedance transformer formed by the interleaved first portions of the helices, the first and second helices are substantially identical, and preferably the turns of the interleaved first helix portions are regularly spaced relative to each other, preferably at substantially half the helix turn pitch.

According to a preferred embodiment, the helically moving means comprises a fixed first insulative material member containing at least part of the first helix and a second insulative material member screwed to the first member and containing at least part of the second helix. Screwing in and unscrewing the second member relative to the first member respectively decreases and increases the length of the radiating non-interleaved helix portions and therefore respectively increases and decreases the tune frequency of the antenna. At least the second portion of the second helix is fixed to the second member. The first and second members in practise constitutes a protective cover for the antenna. An unqualified person can easily select the required frequency by turning the second member on the first member. To this end a frequency graduation is provided along the first member, cooperating with one end of the second member, for example by variable partial overlapping. Screwing/unscrewing the second member is stopped, for example, when the edge of the screwthreaded end of the second member is lined up with the required frequency marked on the graduation.

To fix the antenna to a post, column or any other mounting, it is provided a metal base to one face of which is fixed a microwave line connector having a central conductor connected to a strand of the second portion of the first helix and to the other face of which is applied one end of the first member. The cover formed by the first and second members can be sealed by a gasket washer lodged between the end of the first member and the base. One end of the second member can be closed, preferably by a removable cap through which the two helices are accessible.

To maintain the helices upright with some degree of flexibility in the event of transmission of impact or vibration to the base or the cover, it can be provided a cylindrical insulative material part which is fixed and accommodated substantially axially in at least the first helix, which first helix can be fixed to the cylindrical part; or a cylindrical insulative material part which is mobile with the second helix and is accommodated substantially axially in at least the second helix, which second helix can be fixed to the cylindrical part.

BRIEF DESCRIPTION OF THE DRAWINGS

The foregoing and other objects, features and advantages of the invention will be apparent from the following description of several embodiments of the invention with reference to the corresponding accompanying drawings in which.

DESCRIPTION OF THE PREFERRED EMBODIMENTS

Figure 1:
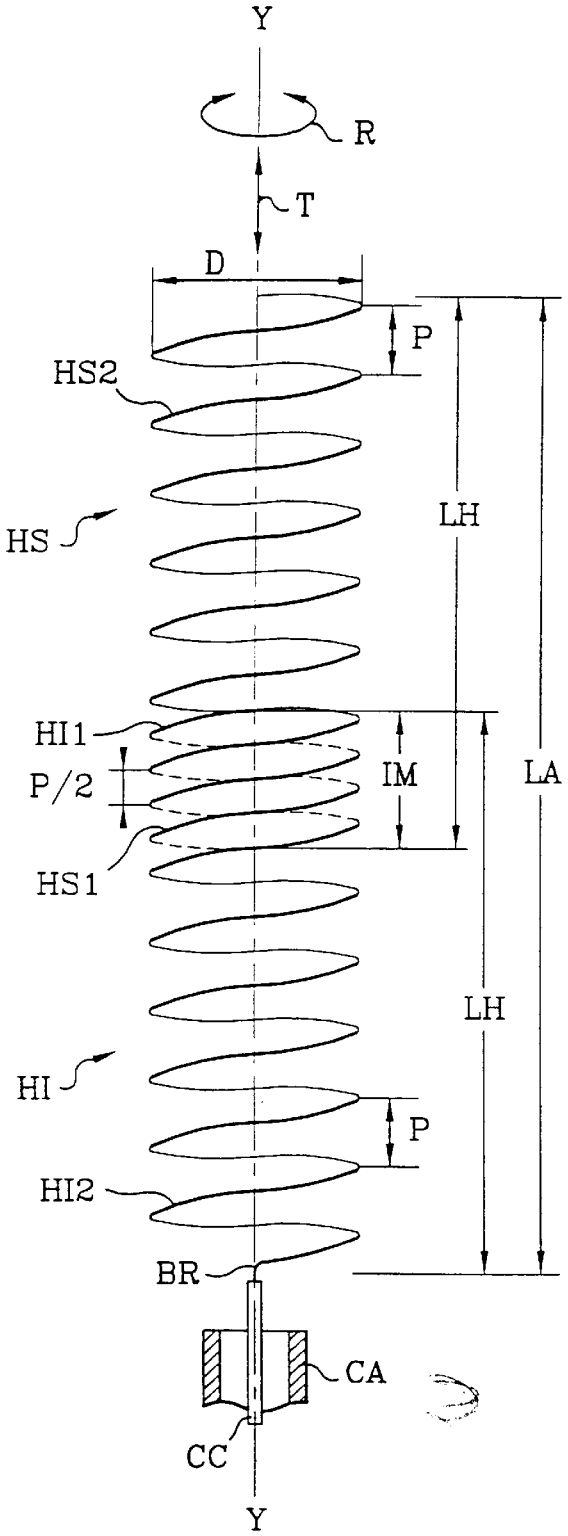
FIG. 1 is a schematic diagram showing the principle of a helical antenna in accordance with the invention.

Referring to FIG. 1, a helical antenna in accordance with the invention comprises two electrically conductive circular helices HI and HS. The helices have a common central axis YY and are substantially identical, i.e. they have constant and substantially equal pitches P, constant and substantially equal diameters D and constant and substantially equal lengths LH. The helices HI and HS have the same handedness; in the embodiment shown, the helices are direct (left-handed) although in a different embodiment they could be retrograde (right-handed).

The helices HI and HS have interleaved first portions HI1 and HS1 and non-interleaved second portions HI2 and HS2 between which the interleaved first portions HI1 and HS1 extend to the center of the antenna.

The turns of the first portion HI1 are parallel to and regularly spaced from the turns of the other first portion HS1 and are not in mechanical contact with the latter. Each turn of one of the first portions HI1 and HS1 is substantially at mid-pitch P/2 of two successive turns of the other first portion.

In one of the helices, for example the first helix HI, the second portion HI2 complementary to the first portion HI1 has an end strand BR connected to the central conductor CC of a coaxial cable CA which is connected to a receiver or to an emitter/receiver. In the other helix, i.e. the second helix HS, the second portion HS2 complementary to the first portion HS1 constitutes the free end of the helical antenna.

In practise the axis YY of the helical antenna extends vertically. For example, the first helix HI is at the bottom of the antenna and the second helix HS is at the top of the antenna. The interleaved first helix portions HI1 and HS1 are then respectively a top portion of the first helix HI and a bottom portion of the second helix HS.

In accordance with the invention, one of the helices HI and HS is mobile helically relative to the other. In the embodiment illustrated the first helix HI is fixed and the second helix HS is helically movable by sliding on itself relative to the other helix, i.e. it moves in translation by the helix pitch P for each complete rotation on itself. In other words, the mobile helix HS can be simultaneously turned about the axis YY of the antenna and moved in translation longitudinally along the antenna axis YY, the helicoidal displacements, that is to say simultaneous rotations and translations of the mobile helix HS being in either direction, as indicated by the double-headed arrows R and T. When the second helix HS is moved helically, the length LA of the antenna decreases, respectively increases, and in the same proportions, the interleaved length IM of the first helix portions HI1 and HS1 increases, respectively decreases, and the effective antenna length (LH-IM) of each of the second helix portions HI2 and HS2 decreases, respectively increases.

The antenna in accordance with the invention is therefore substantially equivalent to a helical antenna which has two radiating portions HI2 and HS2 of variable length (LH-IM) for receiving and/or emitting electromagnetic waves, and a central part of variable length IM consisting of the first end portions HI1 and HS1. The central part of the antenna is analogous to an impedance transformer with a transformer ratio that is always equal to 1 because the numbers of coupled turns of the first portions HI1 and HS1 of the helices are always equal. The impedance transformer is an impedance centering device which is the site of a current antinode. The antenna behaves like a variable length dipole at the center of which the current is variable. The input impedance of the helical antenna is therefore dependent on the number of turns "reduced" by the interleaved first portions HI1 and HS1 of the helices and by the impedance of the helical antenna which is principally made up of the impedances of the second portions HI2 and HS2 of the helices referred to the base of the antenna, at the location of the strand BR.

Accordingly, moving the second helix HS helically relative to the first helix HI and consequently varying the electromagnetic coupling of the helices matches the impedance of the antenna to the characteristic impedance of the feed coaxial cable CA and to the required frequency particularly of a radio station.

Figure 2:
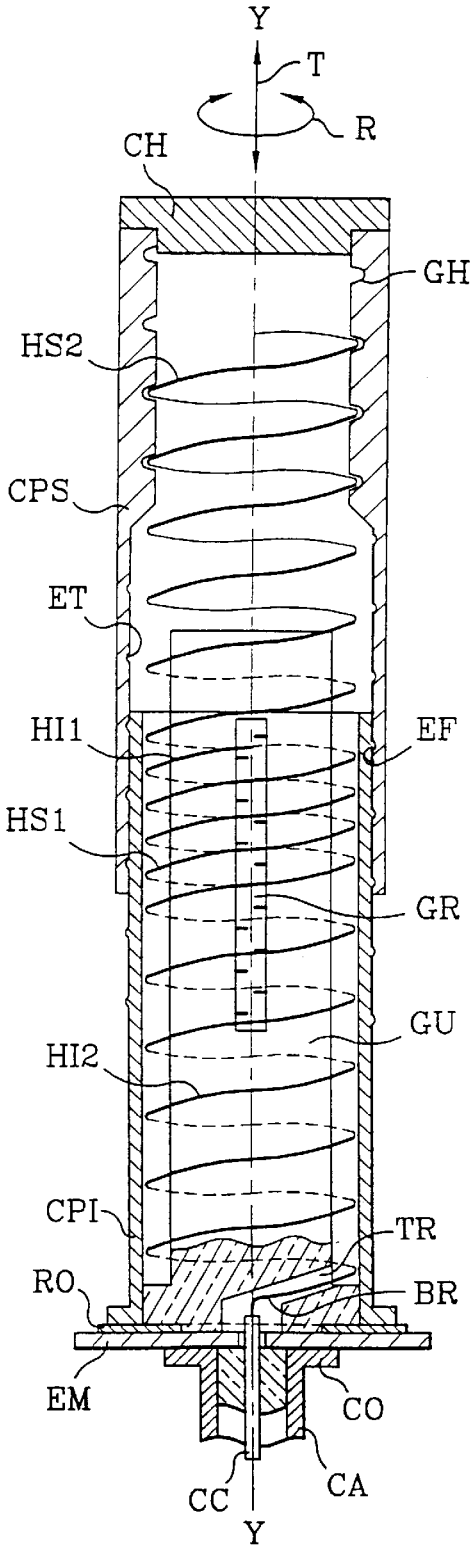
FIG. 2 is a view in axial section of a preferred embodiment of helical antenna in accordance with the invention.

In the preferred embodiment shown in FIG. 2, for example, the helices HI and HS are accommodated substantially in a bottom part CPI and a top part CPS of a hollow insulative material cylindrical cover.

The bottom part CPI is secured with glue or screws to a metal base EM through a rubber gasket washer RO between them. At least part of the helix HI is housed in the cover bottom part CPI and is held coaxial with this cover part CPI around an insulative material cylindrical guide GU which can be longer than the first helix HI, even almost twice as long as each helix HI, HS. Turns of at least the second portion HI2 of the first helix can be glued to the guide GU. The guide GU is fixed, for example glued, to the top face of the metal base EM through the gasket washer RO. A connector CO for the coaxial cable CA is fixed to the center of the bottom outside face of the metal base EM. The strand BR at the bottom end of the bottom portion HI2 of the first helix HI is welded to the central conductor CC of the connector CO via an appropriate hole TR. The base EM is square or circular, for example, and is fixed to the top of a post or a remote-display mast or any other support, or constitutes a base to be fixed to the roof of a vehicle, or to the edge of a table, or to the casing of a microcomputer.

The top cover part CPS has an internally screwthreaded bottom end ET that can be screwed onto an externally screwthreaded top end EF of the bottom cover part CPI. The pitches of the screwthreads of the internally and externally screwthreaded ends ET and EF are equal to the helix pitch P so as to maintain the turns of the helices substantially parallel and equidistant when screwing the part CPS onto the part CPI.

A helical groove GH is formed in the top part of the bore in the cover top part CPS for fixing, for example gluing, at least some of the turns to the top end of the second portion HS2 of the second helix HS. The top of the cover part CPS is closed by an end wall in one piece with the part CPS, or by a cap CH removably fixed to the cover part CPS.

Accordingly, when the top cover part CPS is screwed on or unscrewed from the bottom cover part CPI, the second helix HS descends or rises inside the first helix HI, and to be more precise the variable length IM of the interleaved first helix portions HI1 and HS1 increases or decreases to tune and match the helical antenna to a higher or lower required frequency. The movement of the helix HS relative to the helix HI, to be more precise that of the mobile second cover part CPS relative to the fixed first cover part CPI, is indicated by a graduation GR along the top end of the cover part CPI which is partially covered by the cover part CPS. The graduation has divisions at 5 MHz or 10 MHz, for example, for precise manual tuning of the antenna without using measuring instrument. The graduation is established experimentally at the manufacturing plant and is etched onto the cover part CPI, for example.

Each of the helices HI and HS is made of copper wire coated with a thin sheath of synthetic plastic material or covered with an insulative protective layer, for example a layer of varnish.

Thanks to the absence of mechanical contact between the helices, the antenna in accordance with the invention advantageously offers some degree of flexibility to render it insensitive to vibrations communicated by the antenna support via the base and the cover.

For example, a helical antenna for receiving or emitting radio waves at frequencies lying between approximately 70 MHz and approximately 150 MHz comprises a length of conductive wire for each helix in the order of a quarter-wavelength, i.e. each helix has a length substantially lying between 7 cm and 12 cm, a diameter D approximately lying between 3 cm and 5 cm and a pitch P in the order of one centimeter. The cover CPI-CPS and the other insulative material members GU and CH are made of Plexiglas, for example. The length of the cover varies between approximately 15 cm and approximately 25 cm.

The helical antenna of the invention radiates with linear polarization and has a quasi-omnidirectional diagram in azimuth directions substantially perpendicular to the axis YY, i.e. substantially parallel to the ground.

The helical antenna of the invention above described has not advantageously unnecessary movable parts, direct contacts of the helices with outside, and water infiltration risks. The antenna is insensible to mechanical vibrations. No tool is required to tune the antenna.

Figure 3:
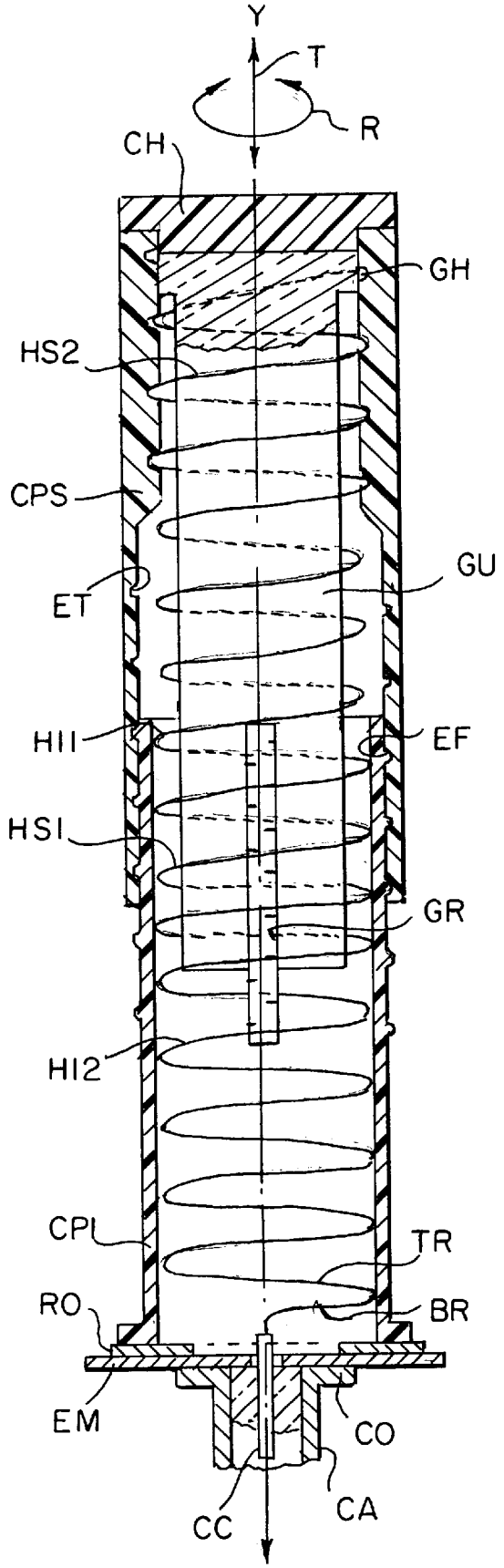
FIG. 3 is an axial sectional view of another embodiment of the invention.

Although a preferred embodiment of the invention has been described, the persons skilled in the art can adapt other embodiments to suit the required frequency tuning and impedance matching. Thus the dimensions of the two helices constituting the antenna can be different, in particular the diameter and the length. As shown in FIG. 3, the inside guide GU can be fixed under the end wall CH of the top cover part CPS instead of being fixed to the base EM, and turns at least of the second portion HS2 of the second helix can be glued to the guide instead of glued into the groove GH as in the embodiment shown. In another variant, the screwthreads on the bottom and top cover parts CPI and CPS are respectively inside and outside screwthreads so that the cover part CPS screws into the cover part CPI.

Other screw-and-nut assembly type arrangements can be used to move helically the second helix by sliding on itself relative to the first helix. The means comprising the first and second cover parts can be associated with a remote controlled motor for automatically moving the second helix and tuning the helical antenna to the required frequency.

What is claimed is:

1. A helical antenna, comprising:

(a) first and second conductive helices extending about a common central axis in the same direction and having first portions interleaved with each other without being in mechanical contact and non-interleaved second portions; and (b) means for helically moving said second helix, by sliding, longitudinally relative to said first helix.

2. The antenna claimed in claim 1, wherein said first and second helices are substantially identical.

3. The antenna claimed in claim 1, wherein the turns of said interleaved first helix portions are regularly spaced relative to each other.

4. The antenna claimed in claim 1, wherein said helically moving means comprises a fixed first insulative material member containing at least part of said first helix, and a second insulative material member screwed to said first insulative material member and containing at least part of said second helix.

5. The antenna claimed in claim 4, wherein at least said second portion of said second helix is fixed to said second insulative material member.

6. An antenna as claimed in claim 4, comprising a metal base having a pair of opposite parallel faces, and a coaxial cable connected with one face of said base, said first insulative member being connected with the other face of said base, said coaxial cable having a central conductor that extends through an opening contained in said base, said second portion of said first helix having a strand connected with said central conductor.

7. An antenna as claimed in claim 6, comprising a gasket washer lodged between said end of said first insulative material member and said base.

8. The antenna claimed in claim 4, wherein one end of said second insulative material member is closed by a removable cap.

9. An antenna as claimed in claim 4, comprising a frequency graduation along said first insulative material member and cooperating with one end of said second insulative material member.

10. An antenna as claimed in claim 1, comprising a cylindrical insulative material part which is fixed and accommodated substantially axially in at least said first helix.

11. An antenna as claimed in claim 1, comprising a cylindrical insulative material part which is mobile with said second helix and is accommodated substantially axially in at least said second helix.

* * * * *